US006655269B2

(12) United States Patent
Litke

(10) Patent No.: US 6,655,269 B2
(45) Date of Patent: Dec. 2, 2003

(54) METHOD FOR FORMING GLOVE WITH CUSTOM LOGO

(75) Inventor: Kenneth S. Litke, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 34 days.

(21) Appl. No.: 09/865,105

(22) Filed: May 24, 2001

(65) Prior Publication Data

US 2002/0174478 A1 Nov. 28, 2002

(51) Int. Cl.[7] ..... A41D 19/00

(52) U.S. Cl. ..... 101/34; 101/483; 428/195; 428/79

(58) Field of Search ..... 101/34, 33, 483, 101/465, 463.1; 428/79, 195

(56) References Cited

U.S. PATENT DOCUMENTS 4,160,904 A * 7/1979 Wilwerding ..... 250/201.8
5,204,164 A * 4/1993 Sangyoji et al. ..... 428/195
5,380,047 A * 1/1995 Molee et al. ..... 283/74
5,391,685 A * 2/1995 Hitomi et al. ..... 522/120
5,411,783 A * 5/1995 Mahn, Jr. ..... 156/234
5,554,032 A * 9/1996 Troudet ..... 434/233
5,658,647 A * 8/1997 Magill et al. ..... 428/195
5,701,815 A * 12/1997 Bocko et al. ..... 101/151
5,933,867 A 8/1999 Corder ..... 2/160
6,134,025 A * 10/2000 Takeuchi et al. ..... 358/1.2
6,229,556 B1 * 5/2001 Venkataraman ..... 347/171

* cited by examiner

*Primary Examiner*—Andrew H. Hirshfeld
*Assistant Examiner*—Dave A. Ghatt

(57) ABSTRACT

A method for attaching a custom logo to a glove is provided. The method utilizes, among other things, a pad printing method to print a custom logo onto a thermoplastic member and adhering the thermoplastic member to a blank glove. The method advantageously allows the customers to attached the logo to the glove away from the manufacturing site, and provides the customers with the flexibility of changing logos to meet changing market demands and to coordinate logos among the customers' various product lines.

15 Claims, 3 Drawing Sheets

METHOD FOR FORMING GLOVE WITH CUSTOM LOGO

FIELD OF THE INVENTION

The present invention relates to a novel method for forming a glove with custom logo.

BACKGROUND OF THE INVENTION

Conventional gloves, including golf gloves, may have logo or insignia attached to the gloves to identify the mark of the glove manufacturers, the mark of the manufacturers' customers or any other markings or aesthetic designs. Conventionally, the logo is made from color yarns stitched directly on to the glove or stitched to a cloth backing, which is then stitched to the glove. U.S. Pat. No. 5,708,979 suggests such method of attachment. This conventional method of attachment requires that the logo be attached to the glove during the manufacturing process of the glove.

This conventional form of attachment offers few opportunities to change the logo to meet ever-changing consumer tastes and market demands. Typically, to change the logo the manufacturer must alter the stitching machine at the manufacturing site and ship the gloves with the new logos to the customer. This process may take significant time to complete, because often the manufacturing site is distant from the customer and the manufacturing site often has other orders waiting to be filled. Furthermore, if the same logo is to be attached to other items, such as golf bags, golf balls, jackets or shirts, the process of coordinating schedules among the different manufacturers becomes cumbersome.

Hence, there remains a need for another method of attaching custom logo to gloves.

SUMMARY OF THE INVENTION

The present invention is directed to a method for forming a glove with a custom logo. This method comprises the steps of forming a thermoplastic pad, printing the logo on the thermoplastic pad, and adhering the thermoplastic pad to the glove. The thermoplastic pad may have a substantially flat shape or curved edges. Preferably, the pad has sufficient flexibility to resist being peeled away from the glove when subject to bending.

Additionally, the method may further include the step of coating the pad with a protective coating before the printing step. The ink used in the printing process may be an ultraviolet curable ink or an electron beam curable ink. These inks have relatively short cure time and are durable, and may be applied on top of the protective coating. The printing step is preferably a pad printing process, which may be an engraving process or an etching process.

In accordance to another aspect of the invention, the printing step comprises the steps of inputting the logo as an image in a computing device, shading the image to create a gray scale bitmap, transferring the bitmap to a plate to form a printing plate, and utilizing the printing plate to print the logo on the thermoplastic pad. The preferred shading method is a dithering shading method. Alternatively, a halftone dot method may be used.

In accordance to another aspect of the invention, the step of adhering the thermoplastic pad to the glove includes applying adhesives or adhesive tape between the pad and the glove. The pad may also be adhered on a recess formed on the glove. Alternatively, the pad may be adhered on top of a strap of the glove or on a recess at the top of the strap.

Alternatively, the thermoplastic pad may be adhered to the glove by melting at least a portion of a surface of the pad opposite to the logo and pressing the pad to the glove to form a bond therebetween.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF THE INVENTION

Figure 1:
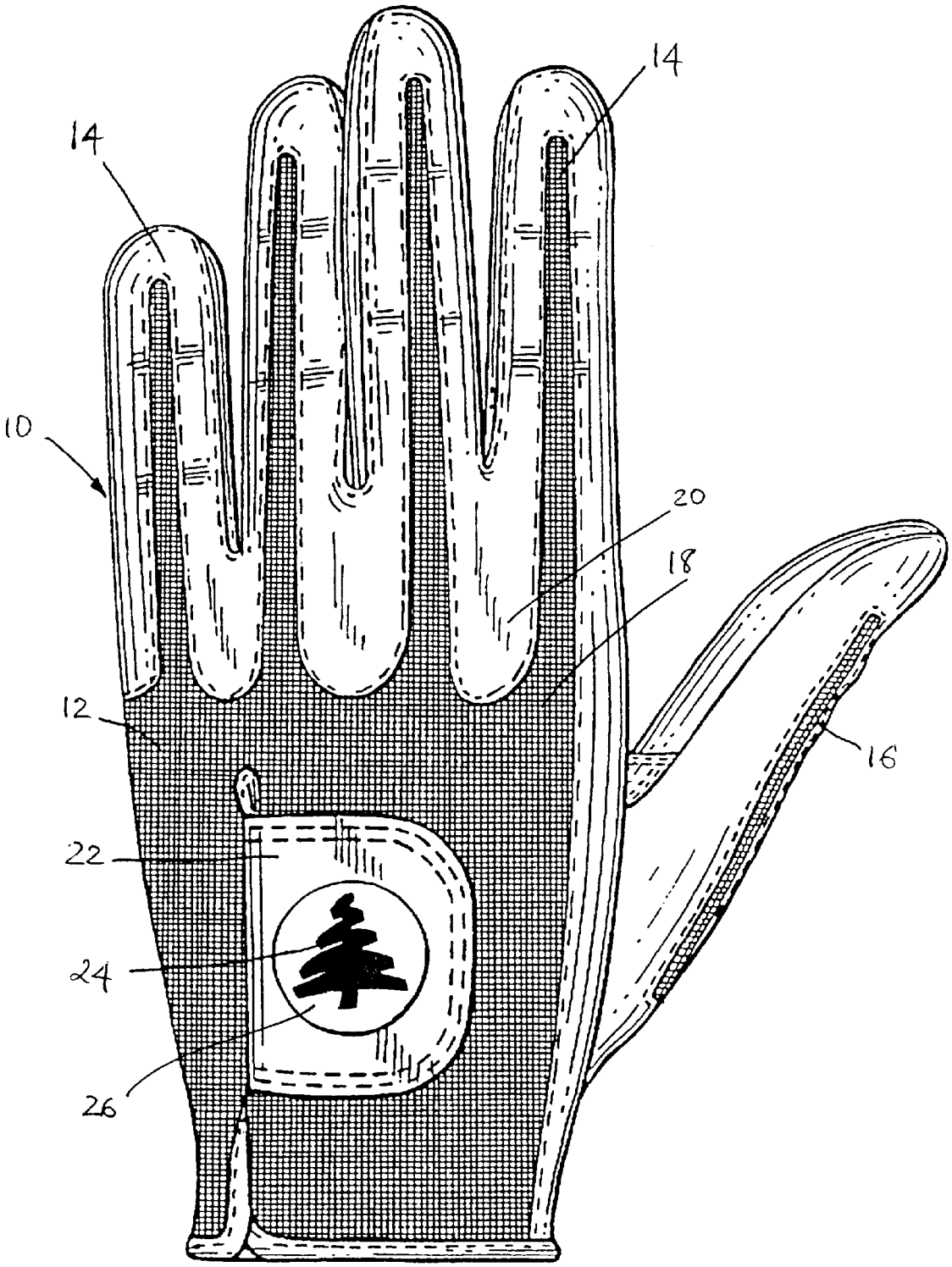
FIG. 1 is a top view of a glove with a custom logo in accordance to a preferred method of the present invention.
Figure 3:
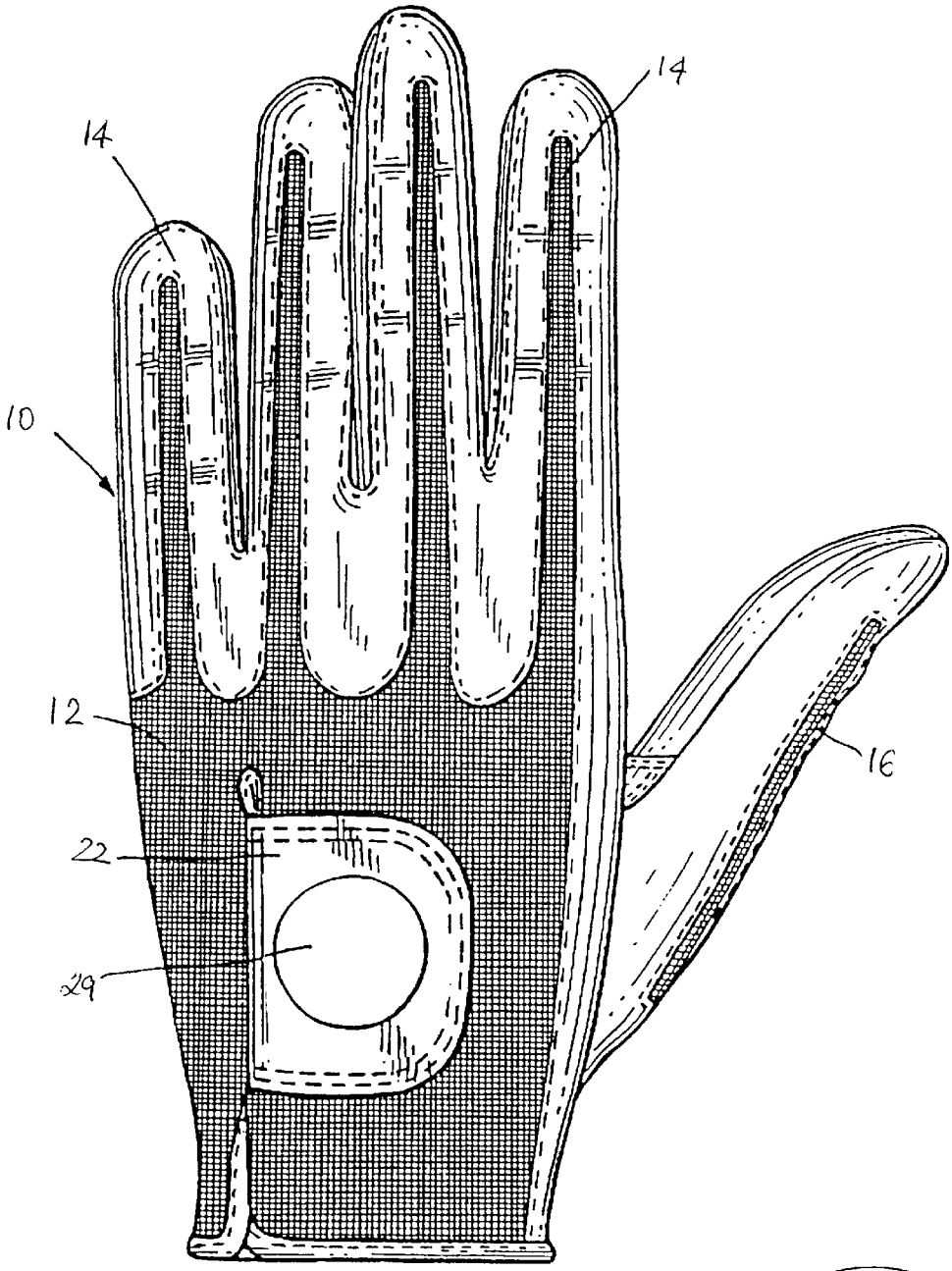
FIG. 3 is a top view of a glove manufactured without a custom logo.
Figure 2:
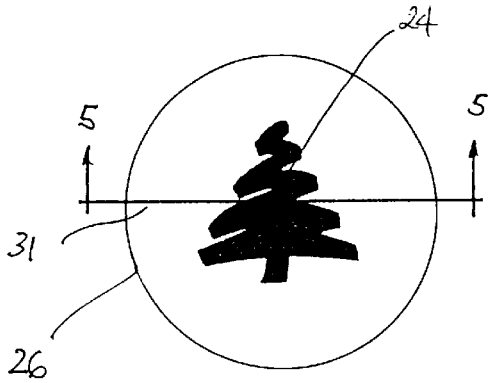
FIG. 2 is an enlarged top view of an exemplary logo pad.

As shown generally in FIGS. 1–3 where like numbers designate like parts, reference number 10 broadly designates a glove, and more preferably a golf glove, which comprises a back covering portion 12, a plurality of finger casings 14 and a thumb casing 16. Preferably, glove 10 is made from a plurality of materials, including relatively solid materials 18 and mesh materials 20. The preferred solid materials include, but not limited to, leather or synthetic materials, which are known in the art. The leather can be modified to provide a surface appearance having a continuous pattern of smooth grain and discontinuous roughened areas. This modification provides improved grip characteristics under certain playing conditions and improves the ability to accept adhesives or to be adhered to thermoplastic pads, as described below. Other suitable relatively solid materials include simulated leather, deerskin, doeskin, steer hide, nylon, vinyl, nylon-acrylic, neoprene, and etc. Suitable mesh materials 20 preferably include one-way stretch materials and two-way stretch materials. Examples of one-way stretch materials include the elastic G8™, a two layer satin-backed material available from Avon Tape, Inc., 46 N. Montello Street, Brockton, Mass. Examples of two-way stretch materials include the elastic G6™, a mesh made from about 66% polyamide and 34% rubber also available from Avon Tape.

Figure 4:
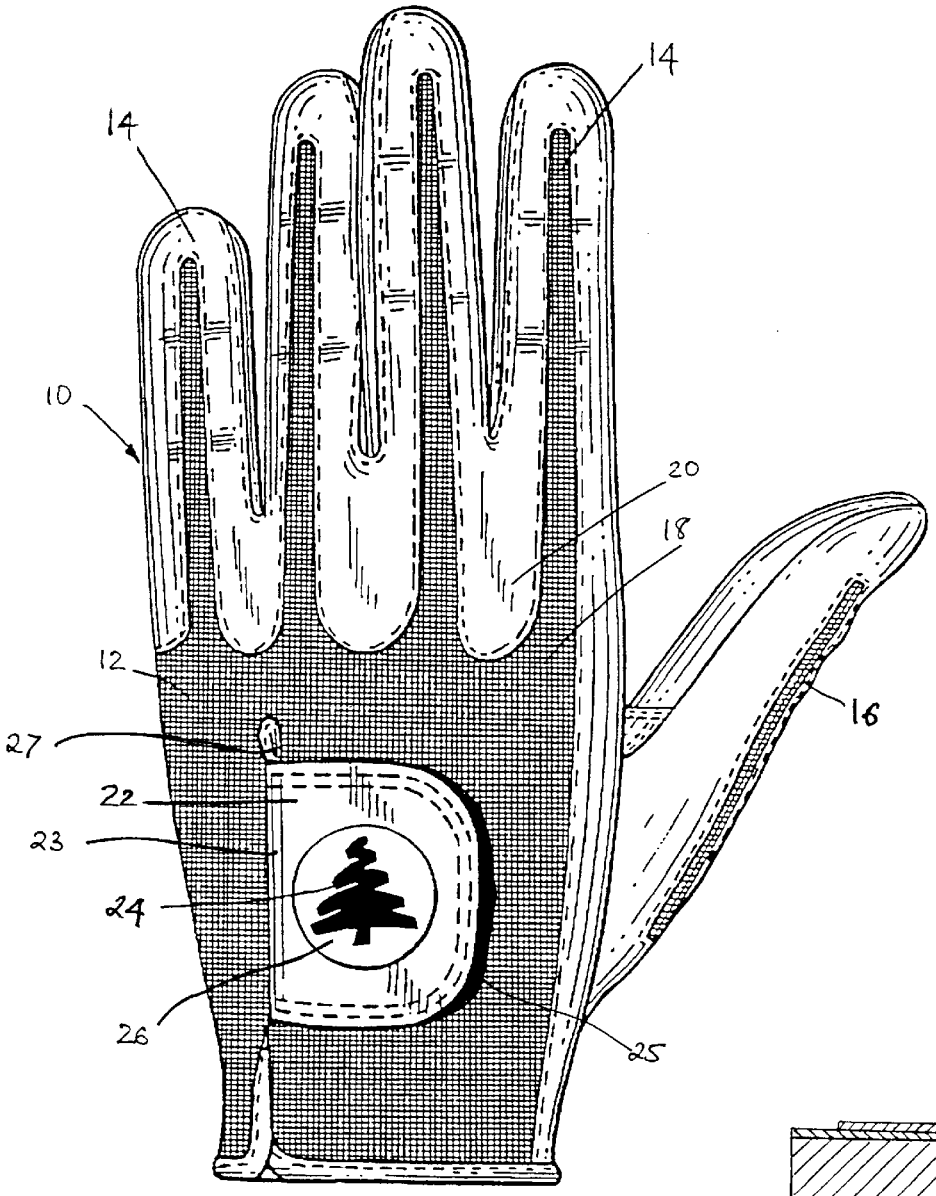
FIG. 4 is a top view of another glove with a custom logo in accordance to another preferred method of the present invention.

In accordance to an aspect of the invention, glove 10 comprises a blank strap 22. Advantageously, strap 22 is adapted to accept a custom logo 24. Glove 10 with blank strap 22, as shown in FIG. 3, is completed at the manufacturing site and can be shipped to the customer for attachment of the custom logo. Custom logo 24, on the other hand, may also be attached to glove 10 at the manufacturing site. Strap 22 is preferably made from the same relatively solid material described above, because this material presents a relatively smooth surface for attachment. Strap 22 may be directly attached to glove 10 by means of adhesives, stitches, fasteners, or the likes, as illustrated in FIGS. 1 and 3. Additionally, strap 22 may be attached at edge 23 to the glove, for example by stitching, and the underside of strap 22 is attached to the glove by hook and loop fasteners 25, as shown in FIG. 4. Advantageously, strap 22 with the hook and loop fasteners and slit 27 allow a user to open and close the glove to facilitate hand insertion.

The advantages of providing glove 10 with blank strap 22 include the flexibility afforded to the customers, such as country clubs and tournament organizers and sponsors, so that they may match logo 24 with logos attached to related products such as golf balls, clothing, golf bags, etc. Additionally, the customers may have multiple logos to be attached to the gloves. The present invention allows the customers this flexibility and cost savings over the conventional practice of creating the multiple logos with color yams and then stitched the logos to the gloves at the manufacturing site. Logo 24 may comprise a single or multiple alphanumeric characters, symbol(s) or image(s). "Custom" refers to the fact that the customers may select the logo.

Logo 24 is preferably imprinted on a thermoplastic pad 26. Suitable thermoplastic materials should be able to accept color inks that make up the logo, and be attachable to the relatively smooth surface of blank strap 22. Suitable thermoplastic materials broadly include ABS plastics (copolymers of acrylonitrile, butadiene and styrene), acetals, acrylics (e.g., polymethyl methacrylate), nylon or polyamide, polyethylene, polypropylene, polyvinyl chlorides (PVC), cellulosics, polycarbonates and polystyrene, among others. The pad may also be made from a urethane or epoxy. Preferably, pad 26 is sufficiently flexible such that when the glove is bent during use the risk of peeling off is minimized. Preferably the pad has a flexural modulus of less than about 10,000 pounds per square inch (psi) and more preferably less than about 2,000 psi. Additionally, pad 26 should also have a Shore A hardness of less than about 95.

Logo 24 and thermoplastic pad 26 may be adhered to blank strap 22 by any known method. Preferably, pad 26 is attached to strap 22 by adhesives. Pad 26 may be attached to the top surface of strap 22, or pad 26 may be received into an optional recess 29 (shown in FIG. 3) sized and dimensioned to receive pad 26. Suitable adhesives include resins based on epoxy, phenolic, polyester, allyl, acrylic, polyvinyl, polystyrene, etc., used singly or in combination or adhesive tapes. Pad 26 may also be attached by partially melting a portion of its bottom surface away from logo 24, and pressing the bottom surface to strap 22 to establish a bond therebetween. The attachment of the pad 26 and logo 24 to glove 10 can be completed by the customer.

Preferably, logo 24 is imprinted on pad 26 using a pad printing process. The pad printing process is described in U.S. Pat. No. 5,778,793. The disclosure of the '793 patent is hereby incorporated by reference in its entirety. Generally, pad printing is an Intaglio-type printing, where an image is cut or incised into a metal plate or a metal plate with a photopolymer coated thereon with various tools or acids. The two basic types of Intaglio printing are (i) engraving the image into the plate with finely ground tools called needles, burnishers, scrapers, and rockers, and (ii) etching the image with acids.

In an engraving process, the artist, by the placement and thickness of the line, creates the custom logo on the printing plate. In an etching process, a metal plate is coated with an acid-resistant wax-base substance called a ground. A fine point-etching needle, which has an extremely fine point, is used to draw the image on the plate. The surface ground is removed wherever the point of the needle makes contact with the plate. The plate is then immersed in a tray containing an acid bath. The acid bites into the plate in the lines exposed by the etching tool; the length of time the plate is exposed to the acid determines the strength of the line.

The metal plate would then have image areas etched below the non-image areas. Hence, it is preferred that that the non-image areas be treated to repel ink. The metal plate, therefore, has image areas recessed below the non-image areas. Ink is applied to the entire plate and then wiped from the smooth non-image surface with a steel blade. The ink remaining in the recesses is transferred to the thermoplastic pad 26 during printing. Typically, the depth of the etched image is from about 5 $\mu$m to 30 $\mu$m.

During the printing process, thinner evaporates from the ink lying in these recesses and the ink surface becomes tacky. A smooth, resilient stamp block of silicone rubber takes up ink from the plate, and transfers it to the thermoplastic pad 26. The stamp block is termed a "pad" and it is this term that has lent its name to the printing process. As the pad pressed over the plate, the tacky ink surfaces stick to the pad. As the pad lifts away from the plate, it takes with it not only the tacky, adhering film, but also some of the more fluid ink underneath. This film of ink is carried to the surface of the thermoplastic pad. On the way, more of the thinner evaporates from the exposed, surface of the ink on the silicone pad, and the ink surface facing away from the pad becomes tacky. As the pad is applied to the thermoplastic pad 26, the film of ink sticks to its surface, and separates from the pad as it is raised. As a result, the custom logo is printed on to the thermoplastic pad 26. Pad printing is known in the art and is described in U.S. Pat. Nos. 5,237,922, 4,803,922, 4,745,857 among others.

In accordance to another aspect of the invention, suitable inks for the printing process described above include ultraviolet curable ink or electron beam curable ink. Heat curable inks are also usable in the present invention. Preferably, suitable ultraviolet curable inks include the ink described in U.S. Pat. No. 6,099,415, which is incorporated herein by reference. The ink disclosed in the '415 patent is curable by ultraviolet radiation and is water insoluble. It comprises an ink base containing a prepolymer with at least two prepolymer functional moieties and a photoinitiator. The prepolymer is selected from the group consisting of an acrylate, an ester and mixtures thereof and a polymerizable monomer. It preferably also has an adhesion-promoting component to ensure that the ink adheres to the thermoplastic pad 26. Generally, the adhesion-promoting component may be a carboxylic acid functional monomer, a carboxylic acid functional oligomer or mixtures thereof. The preferred ultraviolet curable ink may also have a toughening agent sufficient to maintain adhesion of at least about 75% of the logo to the thermoplastic pad. Generally, the toughening agent may be sterically hindered monomers, dimmers, trimers or oligomers, such as sterically hindered acrylates. The toughening agent may also be reactive diluents. More specific examples of this preferred ultraviolet curable ink are disclosed in the '415 patent.

Additionally, suitable electron beam curable inks preferably include the ink described in U.S. Pat. No. 6,001,898, which is incorporated herein by reference. The ink disclosed in the '898 patent is curable by electron beam radiation and is water-insoluble. It comprises an ink base containing at least a prepolymer with at least two prepolymer functional moieties. The prepolymer is selected from the group consisting of an acrylate, an ester and mixtures thereof, and a polymerizable monomer. The preferred electron beam curable ink may similarly have an adhesion promoting component and a toughening agent. More specific examples of this ink are disclosed in the '898 patent.

Figure 5:
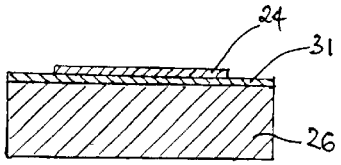
FIG. 5 is a cross-sectional view along line 5—5 of the logo pad of FIG. 2.

Preferably, as shown in FIGS. 2 and 5 a clear or transparent coating 31 may be applied on top of the thermoplastic pad 26 to protect the pad before the logo is printed thereon. Suitable coatings include, but not limited to, urethane, polyester or acrylic. When the preferred ultraviolet curable ink and/or electron beam curable ink are used, the resulting logo 24 is sufficiently durable to withstand repeated uses. Advantageously, the logo 24 can be cured quickly, and since it can be applied over the protective coating, the application of the logo may be the final step in the manufacturing process, thereby reducing manufacturing time. Pad 26 is preferably substantially flat, or alternatively pad 26 may have curved edges.

In accordance to another aspect of the invention, after an artist creates a desired custom logo, it may be input into a computing device, for example by scanning, to further manipulate the logo before etching the logo on the metal plate. Alternatively, the artist may directly draw the custom logo on to the computer, whereby the computer stores the logo digitally. An advantage to inputting the logo into the computer is to have the computer simplify the image by digitally converting it to a gray scale bitmap. Gray scale is a progressive series of shades ranging from black through white. Gray scales are used in computer graphics to add detail to graphical images. Grays may be represented by actual gray shades, by halftone dots, or by dithering as explained below. On the other hand, bit-mapped graphics store, manipulate, and represent images as rows and columns of tiny dots or pixels. In a bit-mapped graphic, each dot or pixel has a precise location described by its row and column. Thus, the location of each dot or pixel is reproducible and can be stored in a computer. Some of the more common bit-mapped graphics formats are called Graphical Interchange Format (GIF), Tagged Image File Format (TIFF), and Windows Bitmap (BMP). Bit-mapped graphics displayed in color require several to many bits per pixel, each describing some aspect of the color of a single spot on the screen.

Hence, the gray scale bitmap produces a plurality of precisely located discrete dots or pixels, which are more easily transferable to the metal plate for the etching process than to draw a smooth, continuous image on to the metal plate by the fine point etching needle. For example, the location and grayness of each dot or pixel stored in computer memory can be transferred to the metal plate using a robotic arm. Each dot or pixel then can be etched from the metal plate to create the pad printing plate described above.

A preferred method of converting the custom logo to grayscale is the dithering shading method. Dithering is a technique used in computer graphics to create the illusion of varying shades of gray (on a monochrome display or printer) or additional colors (on a color display or printer). Dithering relies on treating areas of an image as groups of dots that are colored in different patterns. Dithering takes advantage of the eye's tendency to blur spots of different colors by averaging their effects and merging them into a single perceived shade or color. Depending on the ratio of black dots to white dots within a given area, the overall effect is of a particular shade of gray. Similarly, red dots interspersed with white ones create the illusion of varying shades of pink. Dithering advantageously adds realism to computer graphics and softens jagged edges in curves and diagonal lines at low resolutions. Dithered images simulate shades of gray by arranging dots of the same size in patterns of varying density.

Alternatively, the shading can be accomplished by a halftone method. The halftone method creates a set of tiny, evenly spaced spots of variable diameter that, when printed, visually blur together to appear as shades of gray. In other words, the darker the shade at that particular point in the image, the larger the spot in the resulting grayscale. Halftone spots are typically created electronically by mapping each gray level onto a collection of dots (called a spot). The shading process suitable to the present invention may be accomplished by any method known in the art and the present invention is not limited to they particular shading processes described above.

While various descriptions of the present invention are described above, it is understood that the various features of the present invention can be used singly or in combination thereof. Therefore, this invention is not to be limited to the specifically preferred embodiments depicted therein.

What is claimed is:

1. A method for forming a glove with a logo, comprising the steps of forming a thermoplastic pad;

coating the thermoplastic pad with a protective coating;

pad printing the logo on the protective coating; and adhering the thermoplastic pad to the glove.

2. The method of claim 1 further comprising the step of forming the thermoplastic pad in a substantially flat shape.

3. The method of claim 1 further comprising the step of forming curved edges on the thermoplastic pad.

4. The method of claim 1, further comprising the step of providing a slit in the glove and a strap with hook and loop fasteners to allow a user to open and close the glove; and wherein the adhering step includes adhering the thermoplastic pad to the strap of the glove.

5. The method of claim 4 wherein the adhering step includes adhering the thermoplastic pad to a top surface of the strap.

6. The method of claim 4 wherein the adhering step includes adhering the thermoplastic pad to a recess on the strap.

7. The method of claim 1 wherein the printing step includes the step of applying an ultraviolet curable ink to the thermoplastic pad.

8. The method of claim 1 wherein the printing step includes the step of applying an electron beam curable ink to the thermoplastic pad.

9. The method of claim 1 wherein the pad printing step is an engraving process.

10. The method of claim 1 wherein the pad printing step is an etching process.

11. The method of claim 1 wherein the step of adhering the thermoplastic pad to the glove includes applying adhesives between the thermoplastic pad and the glove.

12. The method of claim 1 wherein the step of adhering the thermoplastic pad to the glove includes melting at least a portion of a surface of the thermoplastic pad opposite to the logo and pressing the thermoplastic pad to the glove to form a bond therebetween.

13. The method of claim 1 wherein the forming step includes forming the thermoplastic pad having a flexural modulus of less than about 10,000 pounds per square inch.

14. The method of claim 13 wherein the forming step includes forming the thermoplastic pad having the flexural modulus of less than about 2.000 pounds per square inch.

15. The method of claim 1 wherein the forming step includes forming the thermoplastic pad having a Shore A hardness of less than about 95.

* * * * *